US007021284B2

(12) United States Patent
Confer et al.

(10) Patent No.: US 7,021,284 B2
(45) Date of Patent: Apr. 4, 2006

(54) METHOD AND APPARATUS FOR MINIMIZING ENGINE AIR TIP-IN NOISE

(75) Inventors: Keith A. Confer, Flushing, MI (US); Gary A. Nichols, Farmington Hills, MI (US); Christopher H. Knieper, Chesaning, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/930,378

(22) Filed: Aug. 31, 2004

(65) Prior Publication Data

US 2006/0042592 A1 Mar. 2, 2006

(51) Int. Cl.
*F02D 11/10* (2006.01)
*F02D 9/10* (2006.01)

(52) U.S. Cl. ..... 123/399; 123/333; 123/403

(58) Field of Classification Search ..... 123/330, 123/333, 361, 396, 399, 403, 342, 337, 488; 701/110; 180/197
See application file for complete search history.

(56) References Cited

U.S. PATENT DOCUMENTS

| | | | | |
|---|---|---|---|---|
| 3,794,004 | A * | 2/1974 | Stoltman | 123/330 |
| 4,721,176 | A * | 1/1988 | Kabasin et al. | 123/333 |
| 4,986,244 | A * | 1/1991 | Kobayashi et al. | 123/488 |
| 5,224,044 | A * | 6/1993 | Tamura et al. | 180/197 |
| 6,755,177 | B1 * | 6/2004 | Woolford et al. | 123/333 |

* cited by examiner

*Primary Examiner*—Willis R. Wolfe, Jr.
(74) *Attorney, Agent, or Firm*—Jimmy L. Funke

(57) ABSTRACT

A method for throttle progression control to minimize tip-in noise of an internal combustion engine by allowing the engine to receive only the required air for the commanded engine acceleration. The method comprises the steps of a) providing an electronically controlled throttle body and valve, b) providing an electronic control module, c) determining the engine air flow required to satisfy a desired engine acceleration, d) providing an input to the electronic control module corresponding to the engine air flow required, e) programming the electronic control module to limit the inflow of air during engine acceleration to match the engine air flow required for achieving said desired engine acceleration, and f) actuating the throttle body and valve to provide the limited air flow through the throttle body during the desired engine acceleration.

4 Claims, 4 Drawing Sheets

METHOD AND APPARATUS FOR MINIMIZING ENGINE AIR TIP-IN NOISE

TECHNICAL FIELD

The present invention relates to internal combustion engines; more particularly, to methods for reducing engine noise; and most particularly, to a method and apparatus for minimizing the engine air tip-in noise that occurs when the throttle valve of a naturally aspirated engine is opened.

BACKGROUND OF THE INVENTION

Internal combustion engines are widely used and their operation is well known. Typically, air for fuel combustion is provided to each firing chamber via individual runners from a central intake air manifold. Acceleration and speed in a naturally aspirated, spark ignition engine are controlled typically by a rotary throttle valve that may be controlled by an operator to variably restrict the volume of air allowed to enter the manifold at any time.

Under engine idle conditions, the throttle valve blade very nearly closes of the throat of the throttle plate assembly, creating a substantial sub-atmospheric vacuum within the manifold. When the throttle valve is opened, the vacuum causes an immediate inrush of air into the manifold. This flow spike is solely in response to the manifold vacuum and the initial filling of the manifold vacuum with air and precedes the actual increase in airflow demand of the engine that occurs as engine speed increases.

The rapid filling of the manifold plenum results in turbulent air flow at the leading and trailing edges of the throttle valve blade and downstream of the valve cross-shaft when the air flows around the shaft are recombined. Such turbulent air flow is characteristic of all throttled engines, to varying degrees, and causes a rushing noise known in the art as "tip-in" noise. This noise is most noticeable when the throttle is quickly opened by rotating the blade through about the first 30° of opening rotation.

It is known to try to reduce tip-in noise by extending a coarse screen across a portion of the throttle throat below the throttle valve. Drawbacks of this approach are a) an increased number of parts, and therefore increased cost of engine manufacture; and b) a fixed flow restriction of incoming air at all flow conditions, some of which would enjoy a non-screen-restricted air flow.

What is needed is a means for minimizing tip-in noise during opening of an engine throttle valve, without creating a permanent air flow restriction.

It is a principal object of the present invention to minimize tip-in noise of a naturally aspirated internal combustion engine while permitting unrestricted air inflow as required by engine speed and acceleration.

SUMMARY OF THE INVENTION

Briefly described, a method for throttle progression control in accordance with the invention to minimize tip-in noise by allowing the engine to receive only the required air for the commanded engine acceleration. The method comprises the steps of a) providing an electronically controlled throttle body and valve, b) providing an electronic control module, c) determining the engine air flow required to satisfy a desired engine acceleration, d) providing an input to the electronic control module corresponding to the engine air flow required, e) programming the electronic control module to limit the inflow of air during engine acceleration to match the engine air flow required for achieving said desired engine acceleration, and f) actuating the throttle body and valve to provide the limited air flow through the throttle body during the desired engine acceleration.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
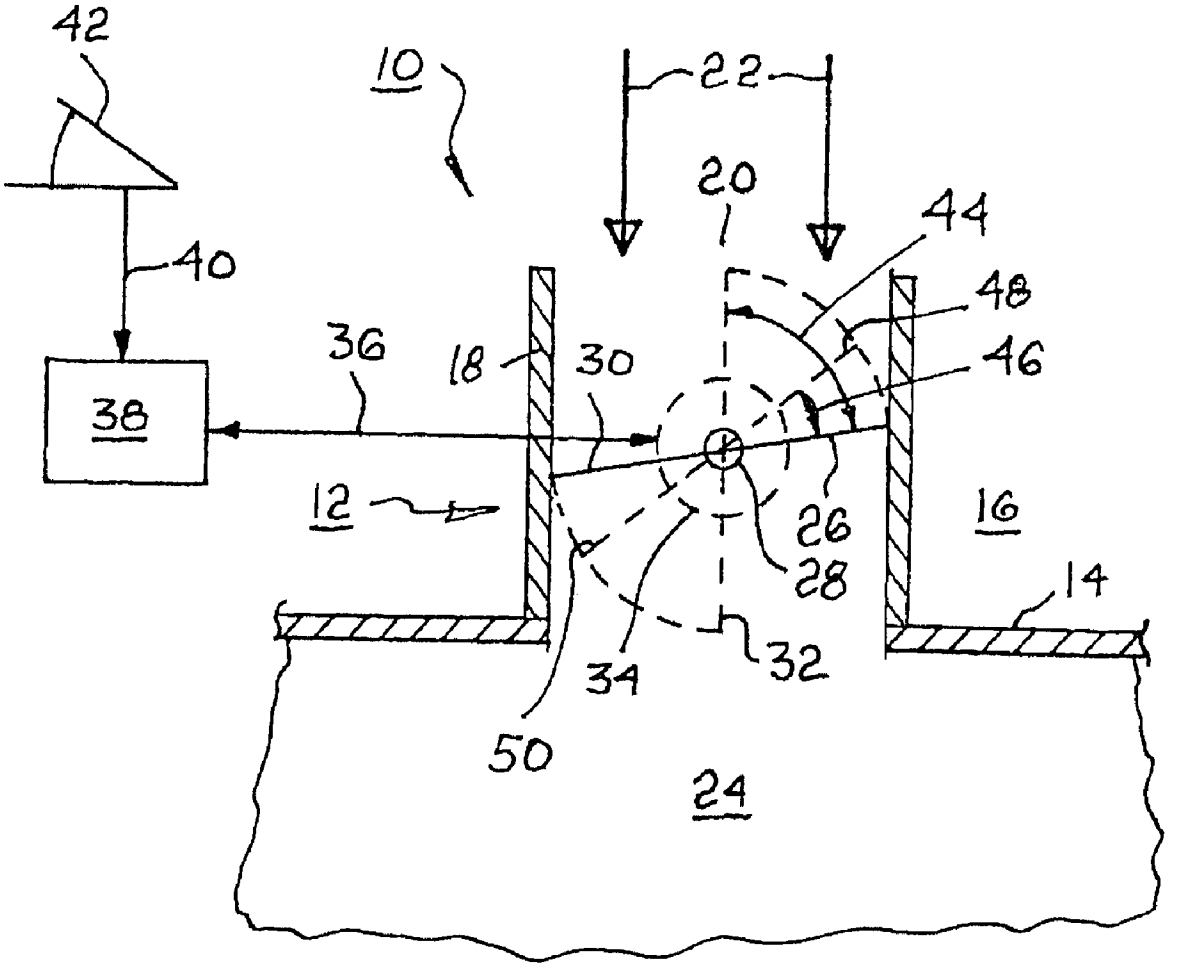
FIG. 1 is a schematic elevational cross-sectional view of a throttle progression control system in accordance with the invention.

Referring to FIG. 1, a system 10 in accordance with the invention for minimizing tip-in noise during early acceleration of an internal combustion engine includes a throttle plate assembly 12 mounted on an intake manifold 14 of engine 16. Assembly 12 includes a barrel portion 18 defining a throat 20 for passage of air 22 from outside of engine 16 into the interior 24 of manifold 14. A throttle blade 26 is disposed on a cross-shaft 28 that is rotatably supported by barrel portion 18. Cross-shaft 28 may be rotated to any position between a first position 30 wherein blade 26 prevents all but idle air flow into interior 24, and a second position 32 wherein blade 26 permits full air flow into interior 24. An electronically controlled feedback actuator 34 controls the rotary angle of cross-shaft 28 in response to signals 36 from an electronic control module (ECM) 38 which is programmed for operation in accordance with the invention. ECM 38 receives demand signals 40 from a variable-position switch 42, such as a vehicle accelerator mechanism controlled by a vehicle operator (not shown) as is known in the art.

The angle 44 between first and second positions 30,32 may approach 90°, although as is known in the prior art, angles of slightly less than 90° are preferred to prevent blade 26 from becoming stuck cross-wise in throat 20.

As noted above, tip-in noise is most objectionable during the early opening angles of blade 26, for example, about the first 30° of rotation (angle 46) when air turbulence is greatest around leading edge 48 and trailing edge 50 of blade 26.

Figure 2:
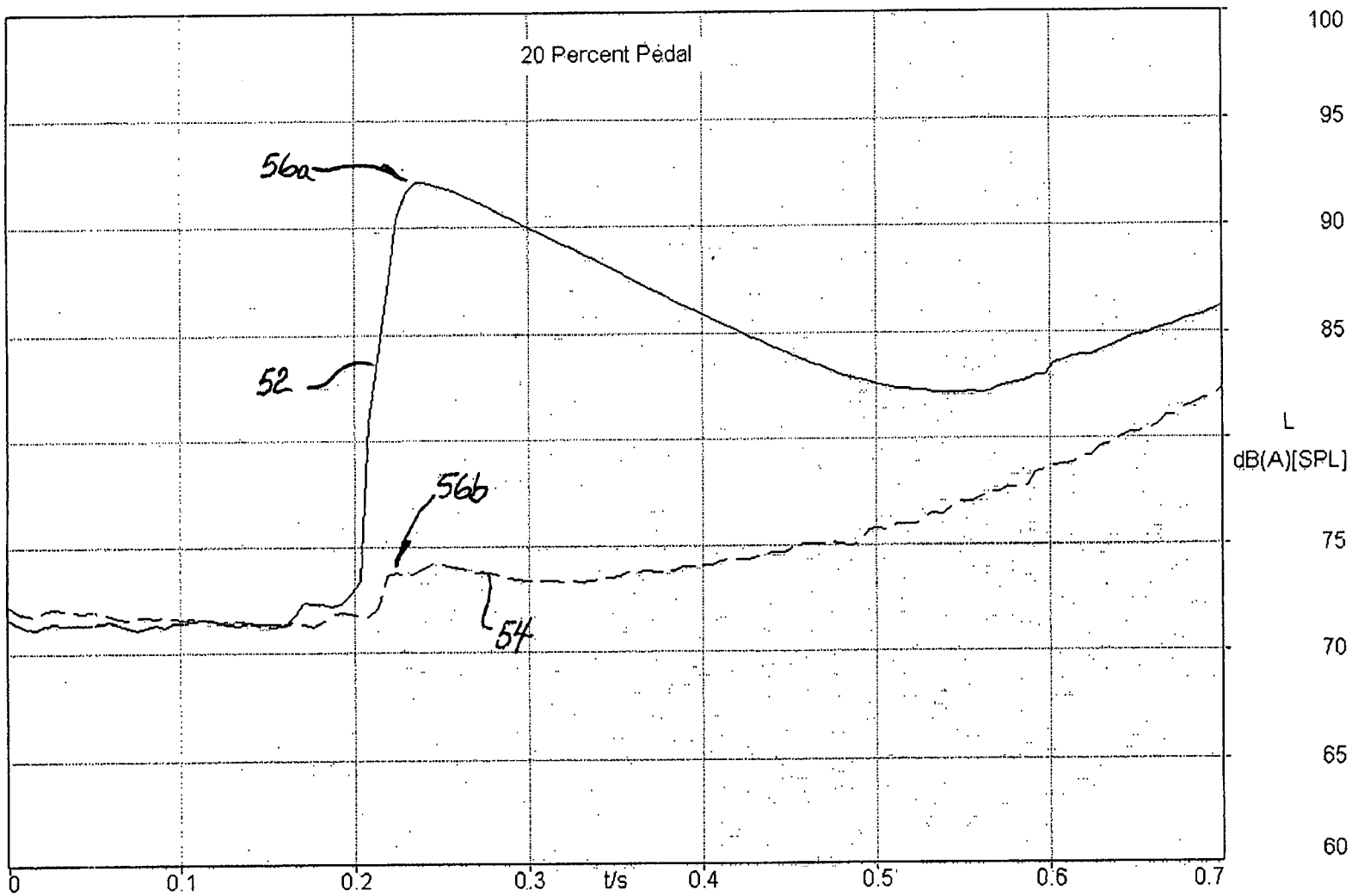
FIG. 2 is a graph comparing prior art engine noise to the reduced engine noise of a throttle system in accordance with the invention when the throttle is opened to 20% of full air flow, as a function of time after acceleration is commanded.
Figure 3:
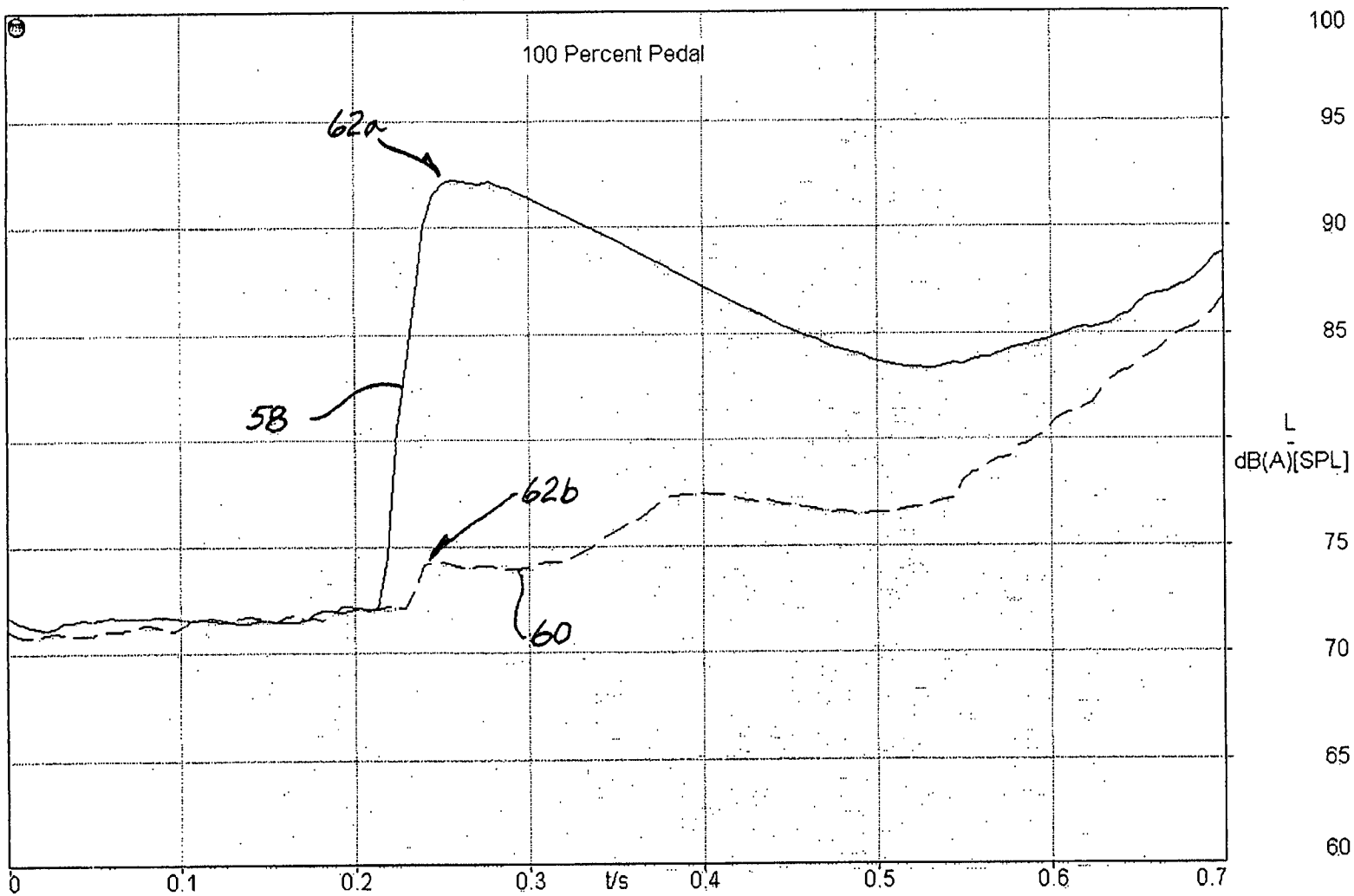
FIG. 3 is a graph comparing prior art engine noise to the reduced engine noise of a throttle system in accordance with the invention when the throttle is opened to 100% of full air flow, as a function of time after acceleration is commanded.

Referring to FIG. 2, a comparison is shown between a prior art engine operated without benefit of the invention (curve 52) and the same engine operated in accordance with the invention (curve 54). In both cases, the throttle opening commanded is 20% of full air flow through throat 20. The benefit of the invention is clearly shown during approximately the first 0.2 seconds after an acceleration demand signal 40 is sent to ECM 38 and relayed via signal 36 to actuator 34 (time=0). Referring specifically to regions 56*a*, 56*b* of the respective curves, it is seen that the tip-in noise with the invention is reduced by about 16 decibels. This represents a significant reduction in tip-in noise volume as perceived by a listener. Referring now to FIG. 3, similar benefits can be seen where the throttle opening commanded is 100% of full air flow through throat 20. Curve 58 is a noise plot of a prior art engine operated without benefit of the invention; noise plot 60 is of the same engine operated in accordance with the invention. Comparing regions 62*a* and 62*b* of these two plots, the tip-in noise with the invention is reduced by about 16 decibels.

Figure 4:
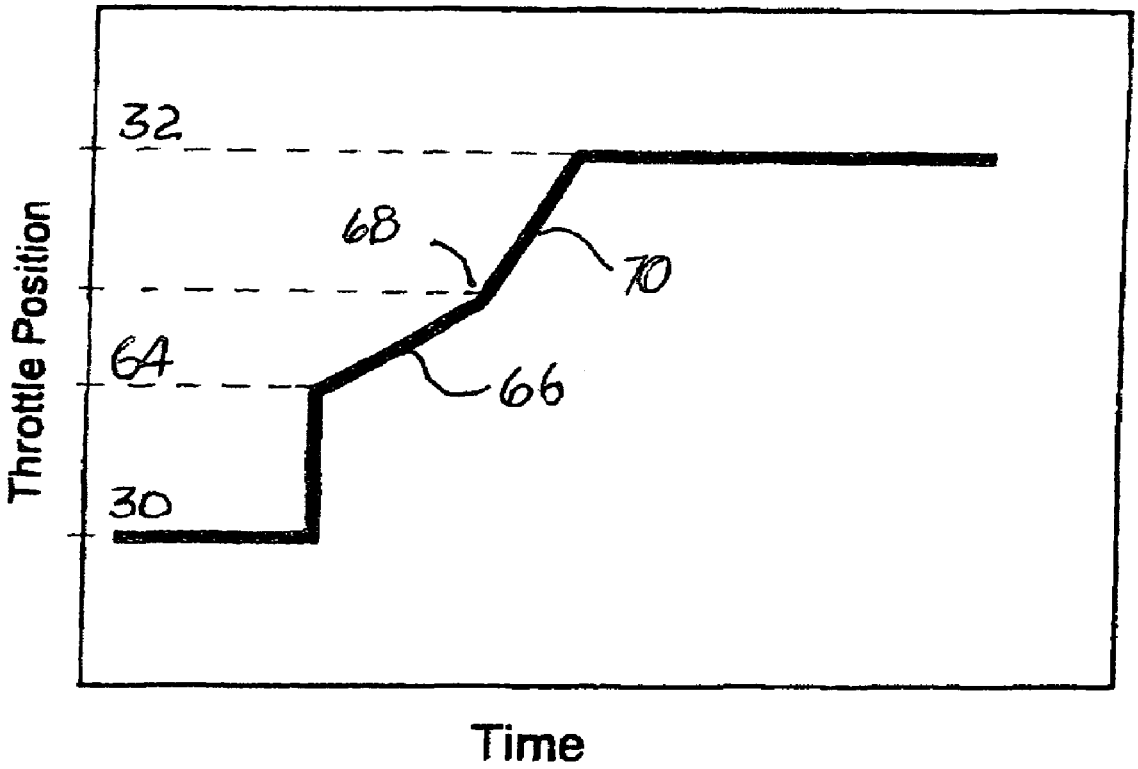
FIG. 4 is a schematic graph showing throttle position as a function of time when an engine is accelerated in accordance with a method of the invention.

Referring to FIG. 4, there is shown a schematic representation of throttle position as a function of time, in accordance with the invention between an first position 30 (idle) and a second position 32 (wide open throttle), both as shown in FIG. 1. Position 64 represents the initial throttle opening as commanded by ECM 38 to admit to manifold 14 only the minimum air flow required for engine combustion under the acceleration conditions demanded by switch 42. Position 64 minimizes the tip-in noise generated by throttle assembly 12. The lag in engine acceleration response needed is readily determined by one of ordinary skill in the art and is programmed into the algorithm in ECN 38 in known fashion. As the engine begins to accelerate in response to the initial command from the ECM, the throttle position follows a first ramp 66 until point 68 where tip-in noise is no longer a potential problem (that is, when the manifold volume is filled) and then follows a second ramp 70 up to the full throttle opening 32 commanded by switch 42.

In the example just shown, the full rotational range of blade 26 is employed for example purposes. Obviously, when a lower maximum engine speed is desired, the curve shown in FIG. 4 is adjusted proportionally, although the principles shown are still followed.

Thus, a naturally aspirated internal combustion, when equipped as shown in FIG. 1 and operated as shown in FIGS. 2–4, avoids high initial in-rush of turbulent air through the throttle throat and around the throttle blade and cross-shaft by allowing the engine to receive only that amount of air required for the commanded rapid acceleration. As a result, a minimum volume level of tip-in noise is produced.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for controlling acceleration of an internal combustion engine to minimize tip-in noise, comprising:

a) a throttle body for delivering air to said engine and comprising a valve moveable between a closed position prior to engine acceleration and an open position during engine acceleration;

b) a electronic control module for controlling actuation of said valve; and c) means for providing an input to said electronic control unit corresponding to a desired engine acceleration;

wherein said electronic control module is programmed to determine a required air flow to satisfy the desired engine acceleration and to provide an output in response to said input to open the valve at a first rate effective to minimize tip-in noise and, after air flow within the throttle body corresponds to the required air flow, to open the valve at a second rate greater than the first rate.

2. A method for throttle progression control for acceleration of an internal combustion engine, said engine comprising a throttle body having a valve electronically controlled by an electronic control module, said valve being moveable between a closed position prior to engine acceleration and an open position during engine acceleration, said method comprising the steps of:

a) when said valve is in said closed position, providing an input to the electronic control module corresponding to a desired engine acceleration;

b) determining, by said electronic control module, a required engine air flow within said throttle body to satisfy the desired engine acceleration;

c) in response to an output by the electronic control module, opening the valve at a first rate effective to minimize tip-in noise; and d) after air flow within the throttle body corresponds to the required air flow; opening said valve at a second rate greater than the first rate.

3. A method in accordance with claim 2 wherein said valve includes a rotatably positionable blade disposed in a valve throat, and wherein said actuating step includes rotating of said blade through an angle of between about 0° and about 30°.

4. A method in accordance with claim 2 comprising the additional steps of:

a) further actuating said valve to follow a first ramp until tip-in noise is no longer a potential problem; and b) still further actuating said valve to follow a second ramp up to a terminal throttle opening.

* * * * *